US008143977B2

(12) United States Patent
Gogeißl et al.

(10) Patent No.: US 8,143,977 B2
(45) Date of Patent: Mar. 27, 2012

(54) ELECTROMAGNETIC DRIVE AND AN ELECTROMECHANICAL SWITCHING DEVICE

(75) Inventors: Christian Gogeißl, Arndorf (DE); Martin Pfeifer, Kümmersbruck (DE)

(73) Assignee: Siemens Aktiengesellschaft, Munich (DE)

( * ) Notice: Subject to any disclaimer, the term of this patent is extended or adjusted under 35 U.S.C. 154(b) by 168 days.

(21) Appl. No.: 12/310,311

(22) PCT Filed: Aug. 16, 2007

(86) PCT No.: PCT/EP2007/058536

§ 371 (c)(1),
(2), (4) Date: Feb. 20, 2009

(87) PCT Pub. No.: WO2008/025685

PCT Pub. Date: Mar. 6, 2008

(65) Prior Publication Data

US 2009/0243770 A1 Oct. 1, 2009

(30) Foreign Application Priority Data

Sep. 1, 2006 (EP) ..... 06018303

(51) Int. Cl.
*H01H 75/00* (2006.01)
*H01H 9/00* (2006.01)

(52) U.S. Cl. ..... 335/6; 335/182; 335/183; 336/181

(58) Field of Classification Search ..... 335/6, 26–34, 335/182, 183; 336/181
See application file for complete search history.

(56) References Cited

U.S. PATENT DOCUMENTS 3,706,916 A * 12/1972 Halbeck et al. ..... 361/102
4,876,521 A 10/1989 Boyd
5,684,443 A * 11/1997 Runyan et al. ..... 335/177

FOREIGN PATENT DOCUMENTS

DE 3908350 9/1990
EP 0626713 11/1994
WO WO 9723890 7/1997

* cited by examiner

*Primary Examiner* — Ramon Barrera
(74) *Attorney, Agent, or Firm* — Harness, Dickey & Pierce, P.L.C.

(57) ABSTRACT

In one embodiment of the present invention, an electromagnetic drive unit including a coil, a yoke, and an armature is disclosed. The winding of the coil is partly wound in one direction and partly in the other direction. An electromechanical switching device includes at least one input terminal and a respective output terminal and an electromagnetic drive unit adapted to limit or to break the electrical current between the at least one input terminal and the respective output terminal.

13 Claims, 2 Drawing Sheets

ELECTROMAGNETIC DRIVE AND AN ELECTROMECHANICAL SWITCHING DEVICE

PRIORITY STATEMENT

This application is the national phase under 35 U.S.C. §371 of PCT International Application No. PCT/EP2007/058536 which has an International filing date of Aug. 16, 2007, which claims priority to European Application No. 06018303.5 which has a filing date of Sep. 1, 2006, which designated the United States of America, the entire contents of which are hereby incorporated herein by reference.

FIELD

At least one embodiment of the invention generally relates to the art of designing electromagnetic drive units and/or to electromechanical switching devices.

BACKGROUND

In the field of low-voltage switching devices that are adapted to switch electric currents over voltages from 100 V up to 1000 V, electromagnetic trigger units, sometimes referred to as n-triggers, are implemented with an electromagnetic drive unit comprising a coil, a yoke and an armature.

An electromagnetic trigger unit is an unit that limits or breaks the current passing through an electromechanical switching device in the event of short-circuit. The trigger unit uses the force generated by the coil and yoke to push or pull the armature so that the current path is broken or limited. Electromagnetic trigger units are commonly used in circuit breakers and current limiters.

An electromagnetic trigger unit is usually adapted to break or limit the current if the rated current is exceeded. To this end, the coil in the electromagnetic drive unit must be able to generate a strong enough magnet field to pull or push the armature with enough force. For electromechanical switching devices that have small rated currents this may be a problem, since the magnet field is proportional to the current flowing through the coil.

For this reason, coils with a high number of windings need to be used in particular for an electromechanical switching device rated for a small current. Since such electromechanical switching devices tend to be rather small, the cross section of the winding must be small too to accommodate the high number of windings.

A winding having a small cross section is not very stable if large currents are carried through it, and so the copper wire of which the winding has been made tends to get permanently damaged in the case of short circuit.

SUMMARY

At least one embodiment of the invention improves the stability of an electromagnetic drive unit against short circuit.

At least one embodiment of the invention improves the stability of an electromechanical switching device against short circuit.

If the winding of the coil of an electromagnetic drive unit comprising a coil, a yoke and an armature is partly wound in one direction and partly in the other direction, one part of the winding will carry current in the other direction than the other part of the winding. Because of the compensating effect of the other part, a part of the winding may not become magnetically effective under normal conditions. But in the event of short circuit, the inductive resistance of the part of the winding that has been wound in the other direction becomes significant and thus tends to limit the short circuit current.

Similar considerations apply to an electromechanical switching device comprising at least one input terminal, a respective output terminal, and an electromagnetic drive unit according to the first aspect of the invention, if the electromagnetic drive unit is adapted to limit or to break the electrical current between said at least one input terminal.

BRIEF DESCRIPTION OF THE DRAWINGS

In the following, the invention is described in more detail with reference to the example embodiments shown in the accompanying drawings, of which.

DETAILED DESCRIPTION OF THE EXAMPLE EMBODIMENTS

Figure 1:
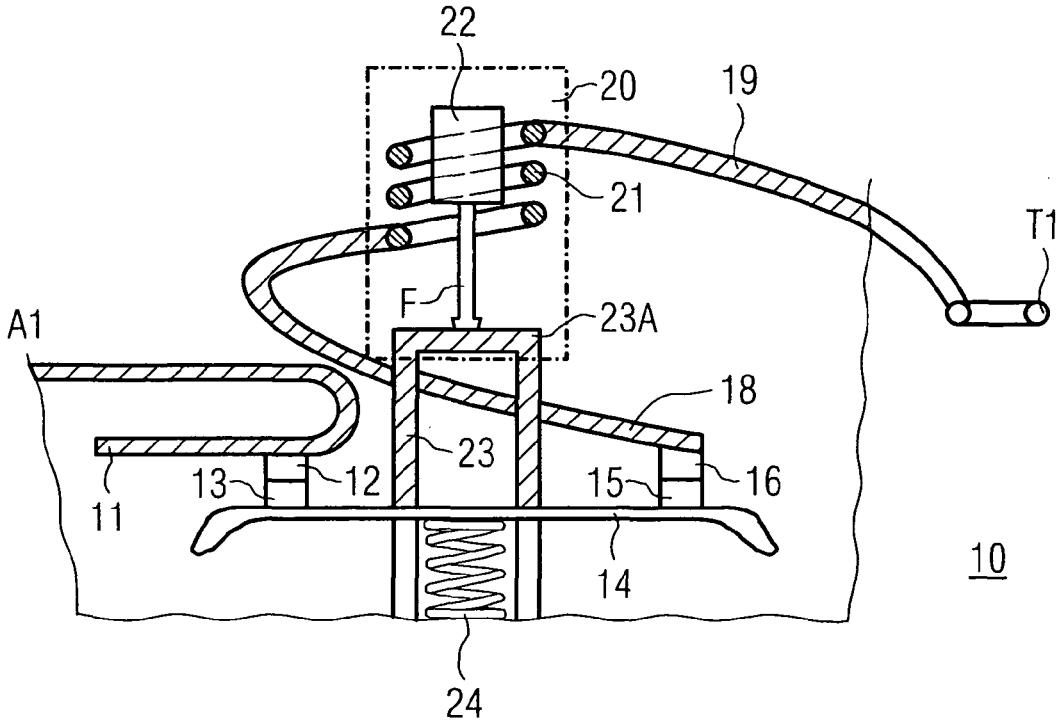
FIG. 1 shows a current limiter.

FIG. 1 shows a current limiter 10 comprising a first current input terminal A1 and a responsive current output terminal T1. The limiter 10 is a limiter for a three-phase current, but for simplicity the components for the two other phases have been omitted from FIG. 1.

Each input terminal A1 of the current limiter 10 receives a phase of a three-phase electric circuit, and passes the electric current via a current rail 11 to a stationary contact piece 12. If the contact bridge 14 is in its normal position, the stationary contact piece 12 is in electrical contact with the movable contact piece 13.

The movable contact piece 13 is in electrical contact with the second movable contact piece 15 via the contact bridge 14. If the contact bridge 14 is still in its normal position, the second movable contact piece 15 is in electrical contact with the second stationary contact piece 16, from which the current may flow via a second current rail 17 to the responsive output terminal T1.

The electric current passing through the contact bridge 14 passed, advantageously after the second stationary contact 16, through an metal conductor 18 to a coil 21 of an electromagnetic drive unit 20. The electromagnetic drive unit 20 monitors the electric current flowing through the limiter 10, and if it detects an excessive electric current, it limits it by displacing the movable contacts 13, 15 from the stationary contacts 12, 16 by exerting a force to the armature 23A that moves the plunger 23 connected to the contact bridge 14.

A biasing spring 24 ensures that the movable contacts 13, 15 cannot be displaced from the stationary contacts 12, 16 until an excessive current is reached, i.e. that the electromagnetic drive unit 20 generates a force F to the armature 23A that is large enough to exceed the balancing force of the biasing spring 24.

Figure 2:
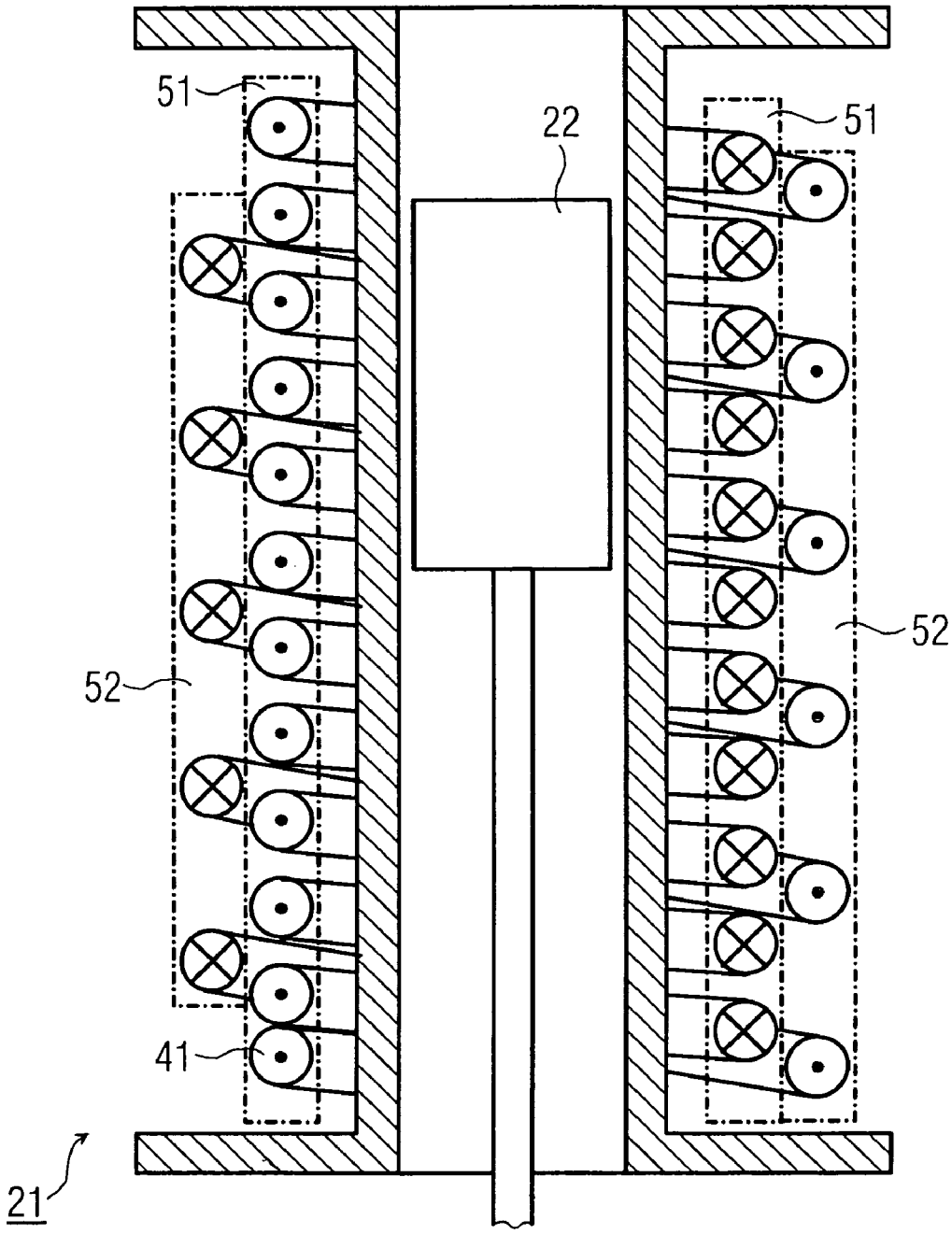
FIG. 2 illustrates an electromagnetic drive unit.

The electromagnetic drive unit 20 comprises a coil 21, a yoke 22 and an armature 23A. The winding 41 of the coil 21, illustrated in FIG. 2, is partly wound in one direction and partly in the other direction. The winding 41 may change its direction layer-wise, i.e. having one or more layers 51 in one direction and then one or more layers 52 in the other direction.

Even though the invention was described by way of a non-limiting example, the skilled person appreciates that the scope of the invention can be interpreted from the attached patent claims. In particular, even though in the examples the electromechanical switching device was a current limiter, in other applications it may be a circuit breaker.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromagnetic drive unit, comprising:

a coil;

a yoke; and an armature directly attached to a movable conductive contact bridge having at least two electrical contacts mounted thereon, one electrical contact on the contact bridge being disposed opposite a stationary contact on a current rail and another electrical contact on the contact bridge being disposed opposite a stationary contact attached to a conductor attached to the coil, wherein a winding of said coil is partly wound in one direction and partly wound in an other direction and the winding includes a first layer wound in the one direction and a second layer wound on the first layer in the other direction.

2. An electromagnetic drive unit according to claim 1, wherein said winding includes multiple layers wound in alternating opposite directions.

3. An electromechanical switching device, comprising:

at least one input terminal connected to the current rail;

at least one respective output terminal; and an electromagnetic drive unit according to claim 1, adapted to generate a force that moves the movable contact bridge to at least one of limit and break electrical current between said stationary contact of the current rails and the at least one input terminal and said at least one respective output terminal.

4. An electromechanical switching device according to claim 3, wherein said electromechanical switching device is a circuit breaker.

5. An electromechanical switching device according to claim 4, wherein said electromechanical switching device is a current limiter.

6. An electromechanical switching device, comprising:

at least one input terminal;

at least one respective output terminal; and an electromagnetic drive unit according to claim 2, adapted to at least one of limit and break electrical current between said at least one input terminal and said at least one respective output terminal.

7. An electromechanical switching device according to claim 6, wherein said electromechanical switching device is a circuit breaker.

8. An electromechanical switching device according to claim 7, wherein said electromechanical switching device is a current limiter.

9. An electromechanical switching device according to claim 1, further including a biasing spring attached to the movable contact bridge that biases the contacts on the movable contact bridge and the stationary contact in a closed position.

10. An electromagnetic drive unit according to claim 1, wherein a first end of the contact bridge and a second end of the contact bridge are configured to be simultaneously connect to an input terminal and an output terminal of the electromagnetic drive unit.

11. An electromechanical switching device according to claim 9, wherein the biasing spring engages the contact bride at an approximately middle portion of the contact bridge.

12. An electromechanical switching device according to claim 9, wherein the biasing spring is a coil spring.

13. An electromagnetic drive unit according to claim 1, wherein the contact bridge is configured to conduct an input voltage from the current rail to the conductor and the coil is configured to receive the input voltage from the conductor and to output the input voltage to an out terminal.

* * * * *